US011359517B2

(12) United States Patent
Porter et al.

(10) Patent No.: US 11,359,517 B2
(45) Date of Patent: Jun. 14, 2022

(54) MODIFIED TWO-PHASE CYCLE

(71) Applicant: Regi U.S., Inc., Spokane, WA (US)

(72) Inventors: Paul Porter, Colbert, WA (US); Allen MacKnight, Spokane, WA (US); Paul W. Chute, Spokane, WA (US); Lynn Petersen, Spokane, WA (US)

(73) Assignee: Regi U.S., Inc., Spokane, WA (US)

( * ) Notice: Subject to any disclaimer, the term of this patent is extended or adjusted under 35 U.S.C. 154(b) by 809 days.

(21) Appl. No.: 16/258,929

(22) Filed: Jan. 28, 2019

(65) Prior Publication Data

US 2019/0234657 A1 Aug. 1, 2019

Related U.S. Application Data

(60) Provisional application No. 62/622,735, filed on Jan. 26, 2018.

(51) Int. Cl.

| | |
|---|---|
| ***F01K 23/04*** | (2006.01) |
| ***F25B 11/02*** | (2006.01) |
| ***F01K 11/00*** | (2006.01) |
| ***F01K 11/02*** | (2006.01) |
| ***F01K 7/02*** | (2006.01) |
| ***F01K 25/10*** | (2006.01) |
| ***F01K 25/06*** | (2006.01) |
| ***F01K 25/08*** | (2006.01) |
| ***F01C 21/10*** | (2006.01) |
| ***F01C 1/344*** | (2006.01) |
| ***F01C 21/08*** | (2006.01) |

(52) U.S. Cl.

CPC ..... *F01K 23/04* (2013.01); *F01K 7/025* (2013.01); *F01K 11/00* (2013.01); *F01K 11/02* (2013.01); *F01K 25/06* (2013.01); *F01K 25/08* (2013.01); *F01K 25/10* (2013.01); *F25B 11/02* (2013.01); *F01C 1/3448* (2013.01); *F01C 21/0836* (2013.01); *F01C 21/108* (2013.01); *F04C 2210/242* (2013.01); *F05B 2210/13* (2013.01); *F25B 2400/071* (2013.01)

(58) Field of Classification Search

CPC ..... F01K 23/04; F01K 7/025; F01K 11/00; F01K 11/02; F01K 25/06; F01K 25/08; F01K 25/10; F25B 11/02; F25B 2400/071; F01C 1/3448; F01C 21/0836; F01C 21/108; F04C 2210/242; F05B 2210/13

USPC ..... 60/653, 677–680

See application file for complete search history.

(56) References Cited

U.S. PATENT DOCUMENTS

| | | | | |
|---|---|---|---|---|
| 3,716,990 | A * | 2/1973 | Davoud | F01K 19/04 60/677 |
| 6,170,264 | B1 * | 1/2001 | Viteri | F25J 3/04018 60/671 |
| 7,896,630 | B2 * | 3/2011 | Grisar | F01C 21/108 418/153 |
| 2005/0241311 | A1 * | 11/2005 | Pronske | F25J 3/04545 60/648 |
| 2007/0199300 | A1 * | 8/2007 | MacAdam | F01K 17/025 60/39.55 |
| 2009/0019853 | A1 * | 1/2009 | Nilsson | F01K 21/047 60/715 |

(Continued)

*Primary Examiner* — Hoang M Nguyen
(74) *Attorney, Agent, or Firm* — Lee & Hayes, P.C.

(57) ABSTRACT

A system including a pump, a boiler coupled to the pump, a turbine coupled to the boiler, a two-phase expander coupled to the turbine, and a condenser coupled to the two-phase expander and the pump.

20 Claims, 8 Drawing Sheets

(56) References Cited

U.S. PATENT DOCUMENTS

2015/0176436 A1* 6/2015 Palmer ..... F01K 25/08
60/681

* cited by examiner

MODIFIED TWO-PHASE CYCLE

CROSS REFERENCE TO RELATED APPLICATIONS

This application claims priority to U.S. Provisional Application No. 62/622,735, filed Jan. 26, 2018, which is incorporated herein by reference.

This application also incorporates by reference U.S. patent application Ser. No. 15/669,589, filed Aug. 4, 2017, which claims priority to U.S. Provisional Application No. 62/394,067, filed Sep. 13, 2016; U.S. Pat. No. 7,896,630, filed Feb. 13, 2007; and U.S. patent application Ser. No. 15/669,625, filed Aug. 4, 2016, which claims priority to U.S. Provisional Application No. 62/394,067, filed Sep. 13, 2016.

BACKGROUND

Power plants generate electricity using fuels such as coal, oil, nuclear, and natural gas. Conventional power plants in their simplest form may include a boiler, a turbine, a condenser, and a pump. Using a Rankine or steam cycle, fuel is burned in the boiler to heat a fluid and generate steam, often to a superheated state. The steam turns blades of the turbine, which is coupled to a generator, to produce electricity. After the steam passes through the turbine, the steam is cooled to a liquid state within the condenser, is pressurized by the pump, and then reenters the boiler.

Conventional systems and methods are designed to extract energy from high-quality or dry steam (i.e., steam that does not include liquid water). As the turbine blades are highly susceptible to erosion, the impingement of water droplets on blades of the turbine may cause significant damage. Due to this concern, after passing through the turbine, the steam must be reheated or condensed. However, reheating the steam increases fuel consumption. Additionally, condensing steam results in heat lost to surrounding environments, thus reducing the overall efficiency of conventional systems.

BRIEF DESCRIPTION OF THE DRAWINGS

The detailed description is described with reference to the accompanying figures. In the figures, the left-most digit(s) of a reference number identifies the figure in which the reference number first appears. The same reference numbers in different figures indicate similar or identical items.

DETAILED DESCRIPTION

Figure 1:
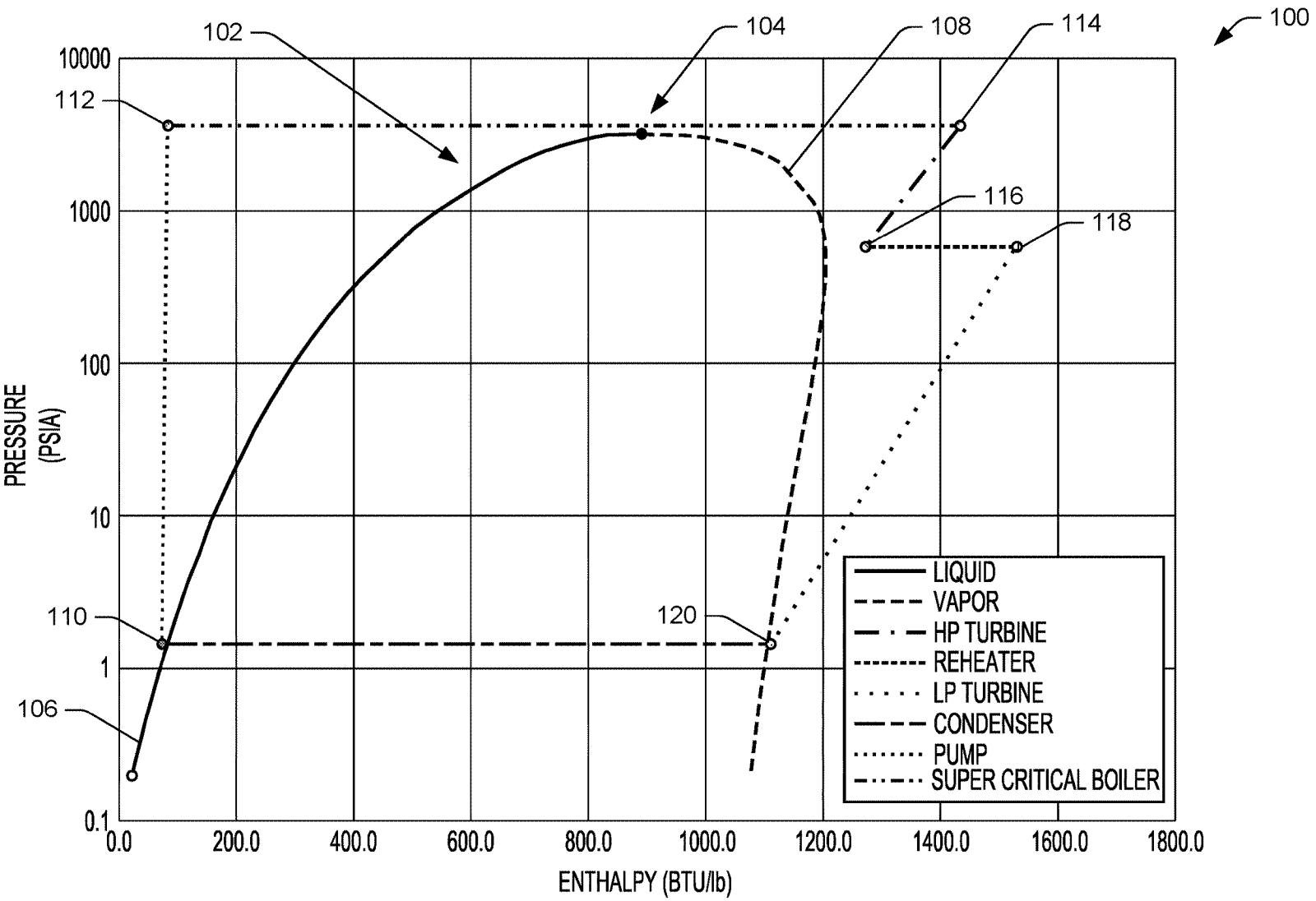
FIG. 1 (Prior Art)
FIG. 1 illustrates an example of pressure-enthalpy curve of a conventional steam cycle.

Mentioned above, turbines are highly susceptible to damage from liquid droplets. As a result, conventional turbines are configured to operate with high-quality steam (e.g., a minimum of 97 percent steam), or steam that contains a low percentage of liquid. In conventional systems, once the turbine extracts energy from the steam, the steam becomes saturated (i.e., including both vapor and liquid) or low-quality. After extracting the available energy, the low-quality steam condenses within a condenser before being pumped to an inlet pressure of the boiler, whereby the process may repeat. In some instances, the steam, or a portion thereof, may pass through a reheater and a secondary turbine(s) prior to being condensed. Reheating the steam may insure that the steam remains as a vapor until expanded to low pressure state within the turbine (or an additional low-pressure turbine). This process requires the addition of energy to reheat the steam to avoid the low-quality steam damaging the turbine blades. A reheater may increase the overall efficiency of conventional systems by adding more energy, however, conventional systems do not recover any of the energy lost in the condenser.

In light of the above, this application describes, in part, systems and methods for implementing a modified two-phase cycle to extract energy from a two-phase fluid (e.g., vapor and liquid). For instance, the modified two-phase cycle or systems implementing the modified two-phase cycle, may extract energy from high-quality steam in a superheated phase while also extracting energy from low-quality steam, or in instances where the steam is saturated with liquid. Compared to conventional systems or steam cycles (e.g., Rankine) whereby heat is removed within the condenser to condense low-quality steam to a liquid, the modified two-phase cycle discussed herein may utilize low-quality steam to create additional power. In other words, after passing or diffusing through the turbine and becoming low-quality, remaining enthalpies within the low-quality steam may be captured before the fluid is condensed within the condenser.

In some instances, the energy (i.e., enthalpy) of the two-phase fluid is captured utilizing an expander. The expander may include a low-speed and/or positive-displacement expander having an integrated or associated generator operably coupled thereto. For instance, the expander may include reciprocating vanes that receive the low-quality steam from an outlet of the turbine and expand the low-quality steam. Expanding the low-quality steam may create rotary motion that is converted into energy. In some instances, using an expander having a low-speed and/or positive-displacement design may prevent the expander experiencing erosion typically encountered by conventional turbines (or turbine-generators). Consequently, the expander may capture energy contained within a two-phase fluid or low-quality steam without suffering detrimental effects.

Additionally, or alternatively, systems and/or the modified two-phase cycle discussed herein may include or utilize a compressor to compress the two-phase fluid. In some instances, steam within the two-phase fluid may be compressed to conserve energy, or an enthalpy of the fluid, that is otherwise lost to the environment within the condenser. That is, the compressor may compress the two-phase fluid or steam within the two-phase fluid to an increased pressure and until the two-phase fluid becomes 100 percent liquid or substantially 100 percent liquid. In some instances, the compressor may comprise a low-speed and/or positive-displacement compressor that includes reciprocating vanes. The compressor may receive the low-quality steam or two-phase fluid from the condenser and compress the low-quality steam into liquid.

Accordingly, systems or methods employing the modified two-phase cycle described herein may utilize the expander and/or the compressor to increase an efficiency of conventional steam cycles. More particularly, the expander may capture energy from two-phase fluids typically lost in conventional cycles, while the compressor may conserve energy typically expelled to environments during condensing. Additionally, although the examples herein are described as using water as the working fluid, other two-phase fluids may be used. For instance, the systems or methods employing the modified two-phase cycle described herein may use refrigerants or inorganic fluids such as ammonia, as the working fluid.

The present disclosure provides an overall understanding of the principles of the structure, function, manufacture, and use of the systems and methods disclosed herein. One or more examples of the present disclosure are illustrated in the accompanying drawings. Those of ordinary skill in the art will understand that the systems and methods specifically described herein and illustrated in the accompanying drawings are non-limiting embodiments. The features illustrated or described in connection with one embodiment may be combined with the features of other embodiments, including as between systems and methods. Such modifications and variations are intended to be included within the scope of the appended claims.

FIG. 1 illustrates a conventional Rankine or steam cycle on a pressure-enthalpy diagram 100 and is included to provide background for the present disclosure. Pressure is shown on the y-axis while enthalpy is shown on the x-axis.

The diagram 100 contains a curve 102 having a critical point 104. The portion of the curve 102 that lies to the left of the critical point 104 indicates a saturated liquid line 106, while the portion of the curve 102 that lies to the right of the critical point 104 indicates a saturated vapor line 108. The locations on the curve 102 to the left of the critical point 104, on the saturated liquid line 106, indicate that the fluid is in liquid form (i.e., 100 percent liquid), while the locations on the curve 102 to the right of the critical point 104, on the saturated vapor line 108, indicate the fluid is steam, or vapor (i.e., 100 percent steam).

The area underneath the curve 102 (i.e., the vapor dome) represents a mixture of both liquid and steam.

In conventional steam cycles, liquid is pumped from a low-pressure state to a high-pressure state, between 110 and 112, using a condensate pump and/or a feedwater pump. In some instances, the liquid may be pumped to pressure equal to or substantially equal to an operating pressure of a boiler. Within the boiler, between 112 and 114, the high-pressure liquid is converted into steam, thereby increasing in enthalpy. After the liquid turns to steam, or becomes superheated or high-quality (i.e., 100 percent steam), the steam enters a high-pressure (HP) turbine, between 114 and 116, whereby the turbine extracts energy (i.e., enthalpy) from the fluid. Next, the steam may be reheated at point 116 in a boiler to increase the enthalpy of the steam, as shown at 118.

As illustrated in FIG. 1, reheating the steam at 116 occurs before the steam reaches the saturated vapor line 108. Noted above, reheating the steam avoids the steam becoming low-quality, which represents the proportion of steam versus liquid, expressed as a percent. That is, steam with a quality of 0 indicates 100 percent liquid, while steam with a quality of 100 indicates 100 percent vapor. Given concerns for erosion and damage to turbine blades, turbines are designed to operate in the superheated region, where steam quality is high and often times has zero percent liquid. Accordingly, reheating the low-quality steam, or as the steam becomes low-quality (e.g., after/while passing through the turbine) increases the percentage (or amount) of steam within a fluid. However, while reheating may help improve overall cycle efficiencies, reheating also increases the net energy required and conventional systems are still unable to recover any of the energy lost to the environment by the condenser, which can represent close to 50 percent of the total energy input by the boiler(s).

After reheating, the steam may enter a low-pressure (LP) turbine until the steam reaches (or approaches) the saturated vapor line 108, as shown at 120. Thereafter, between 120 and 110, the steam is condensed in a condenser. In doing so, under the vapor dome the fluid becomes two-phases (i.e., liquid and steam). Prior to being pumped back to a high-pressure state (e.g., between 110 and 112), and within the condenser, the fluid transfers heat to another working fluid (e.g., river water, sea water, or ambient air). The fluid therefore undergoes a phase change from steam to a liquid between 120 and 110. However, this phase change results in a significant amount of enthalpy (i.e., heat) being lost to an environment.

Figure 2:
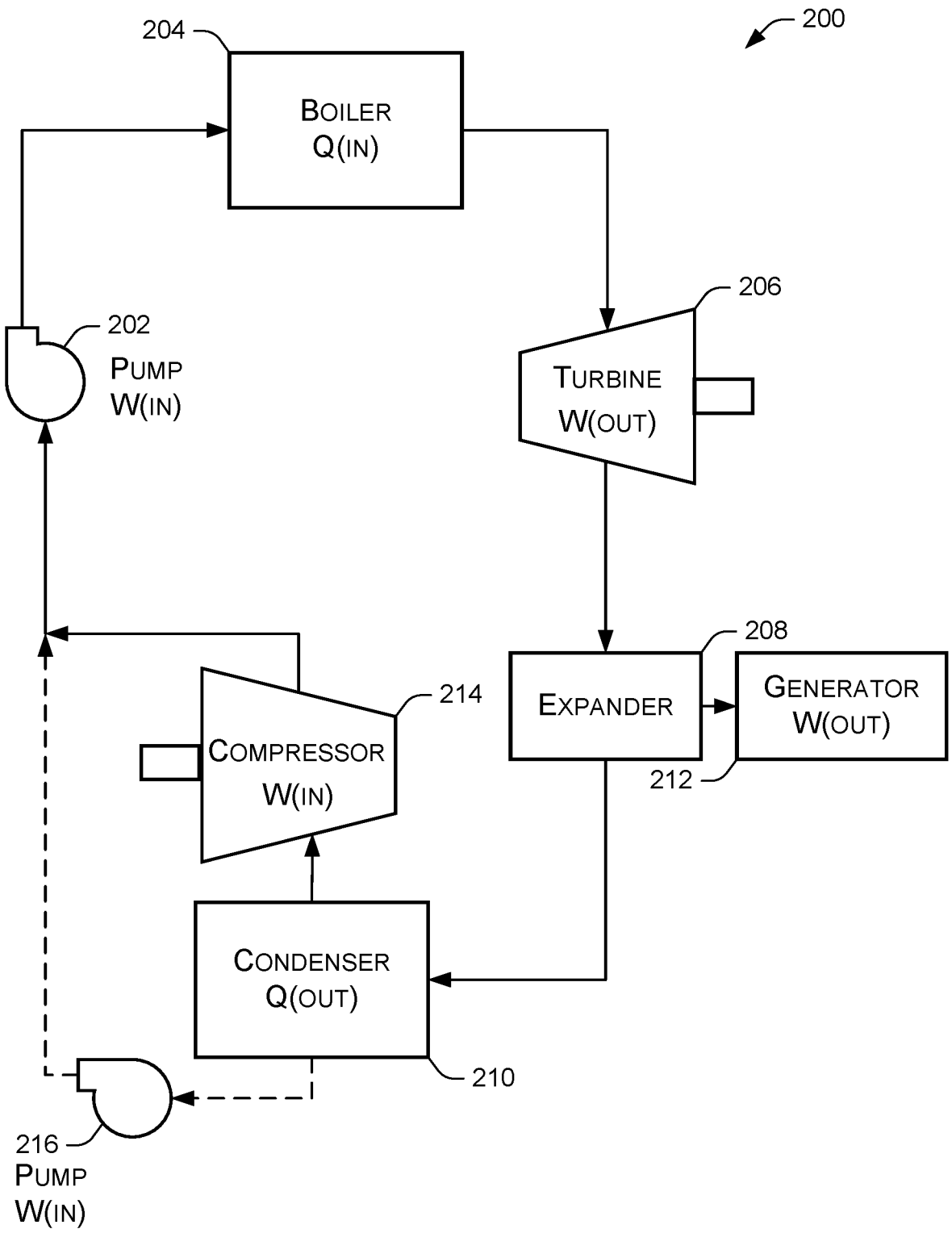
FIG. 2 illustrates an example system usable to implement a modified two-phase cycle, according to an embodiment of the present disclosure.

FIG. 2 illustrates an example system 200 according an embodiment of the present disclosure. The system 200 may include a pump 202 that pumps a fluid, such as high-quality liquid having zero percent steam, into a boiler 204. The boiler 204 may heat the fluid to a superheated state to create steam. In some instances, the boiler 204 may heat the fluid to high-quality steam that contains zero percent or substantially zero percent liquid. Thereafter, the steam may enter a turbine 206 and rotate turbine blades to create power, via a generator coupled to the turbine 206. After passing through the turbine 206, the steam may enter an expander 208. As shown in FIG. 2, the expander 208 may be positioned between the turbine 206 and a condenser 210. In some instances, the expander 208 may receive high-quality steam or saturated steam from the turbine 206. For instance, the expander 208 may receive the steam once the turbine 206 has extracted all available energy and before the fluid becomes two-phases or reaches a saturated vapor line, so as to avoid detrimental effects to the turbine 206.

In passing through the expander 208, or while passing through the expander 208, the steam may expand to a two-phase fluid (e.g., steam and liquid). In some instances, the expander 208 may comprise a low-speed and/or positive-displacement expander. By using an expander having a low-speed and/or positive-displacement design (i.e., the pressure of the fluid is decreased by increasing its volume), the expander 208 may not suffer from erosion. Consequently, the expander 208 may operate with two-phase fluids that includes a mixture of both steam and liquid without causing appreciable erosion to components of the expander 208.

Expanding the steam into the two-phase fluid may create rotary motion that is used to create power, for instance, via a generator 212 operably coupled to the expander 208. Alternatively, the expander 208 may also include an integrated generator. For example, the expander 208 may be configured to generate electricity, as discussed in U.S. patent application Ser. No. 15/669,589.

Noted above, in some instances, the expander 208 may be configured to create power using low-quality steam. For instance, in some examples, the expander 208 may be configured to create power from steam having a quality at or below 75 percent. In other words, the expander 208 may be configured to create power from steam from a superheated state or from a quality of at least (or about) 97 percent down to a quality of about 75 percent. However, in other examples, the expander 208 may be configured to create power from steam having any quality from 0 to 100 an expand superheated steam to a quality that provides the greatest efficiency for the system and heat source.

After passing through the expander 208, the fluid (now two-phases) may enter the condenser 210 where the fluid may condense and cool for reuse by the boiler 204. However, in some instances, from the condenser 210, or while being condensed, a portion of the fluid may be compressed within a compressor 214 to a liquid state (e.g., about or substantially 97 percent liquid). In some instances, the compressor 214 may include a low-speed and/or positive-displacement compressor to compress the fluid. Including the compressor 214 and compressing the steam, as compared to waiting for the steam to condense and become pure liquid, the amount of condensing may be reduced, and consequently, compressing the steam into liquid may minimize the amount of energy lost within the condenser 210. Therefore, an amount of energy required in the boiler 204 to heat the liquid to superheated steam may be reduced. In other words, including the compressor 214 compresses the steam to a pressure where it becomes a liquid retains the enthalpy of the fluid otherwise lost through condensing the steam and/or fluid in the condenser 210 alone. In some instances, the compressor 214 may receive, or draw, the steam from the two-phase fluid so as to only compress the vapor portion.

FIG. 2 also illustrates that the system 200 may include a pump 216 to draw liquid from the condenser 212 and pump the liquid to a point after which the fluid exits the compressor 214. Here, fluid exiting the compressor 214 may combine with fluid being pumped by the pump 216. However, as shown by the dashed line, including the pump 216, and bypassing the compressor 214, represents an optional or additional configuration of the system 200. For instance, in some instances, the pump 216 may be selectively utilized in instances where the condenser 210 is not operating efficiently to draw liquid from within the condenser 210 and pump the liquid directly back to the boiler 204 or to a point where the fluid exits the compressor 214. In doing so, the compressor 214 may compress remaining steam within the two-phase fluid before being pumped by the pump 202 into the boiler 204.

While the above system 200 includes the condenser 210, in some instances, the condenser 210 may be omitted from the system 200. In such instances, the compressor 214 may receive the fluid directly from the expander 208. Additionally, or alternatively, in some instances the system 200 may not include the compressor 214. Here, the fluid may exit the condenser 210, or the expander 208 in instances where the condenser 210 is omitted, before being pumped by the pump 202 into the boiler 204. Still, the system 200 may additionally, or alternatively, omit the expander 208 such that the condenser 210 directly receives the fluid from the turbine 206. Accordingly, in some instances, the system 200 may include the expander 208 and/or the compressor 214.

In some instances, the efficiency of the system 200 may be maximized or optimized by including both the expander 208 and the compressor 214, where the expander 208 and compressor 214 both individually, and collectively, increase the efficiency of the system 200. In some instances, the expander 208 and/or the compressor 214 may, collectively or individually, improve the efficiency of conventional systems between 5% and 10%, 10% and 15%, or 15% and 20% by extracting energy from two-phase fluids (i.e., under the vapor dome) or low-quality steam, as compared to conventional cycles or systems that are unable to extract such energy.

While the system 200 is described as having certain components, additional components not shown or described may be included to permit performance or operating of the system 200. For instance, the system 200 may include valves, additional pumps, separators, and so forth. Additionally, while the expander 208 and/or the compressor 214 have been described, other positive displacement technology may be used to extract energy from two-phase fluids. For instance, the system 200 may, additionally or alternatively, use positive-displacement screw technology, positive-displacement piston technology, or other like. Additionally, or alternatively, other rotary devices such as radial flow low speed turbines or centrifugal devices capable of handling two-phase fluids may be used to extract energies from two-phase fluids. Still, the system 200 may include expanders and/or compressors that may not include rotary devices and/or positive-displacement devices. The system 200 may also be used with fuel sources that do not have specific energies capable of heating a liquid to a superheated state. In such instances, the system 200 may be configured to operate under the vapor dome, and extract energy from a two-phase fluid, without heating the fluid to a superheated state.

Figure 3:
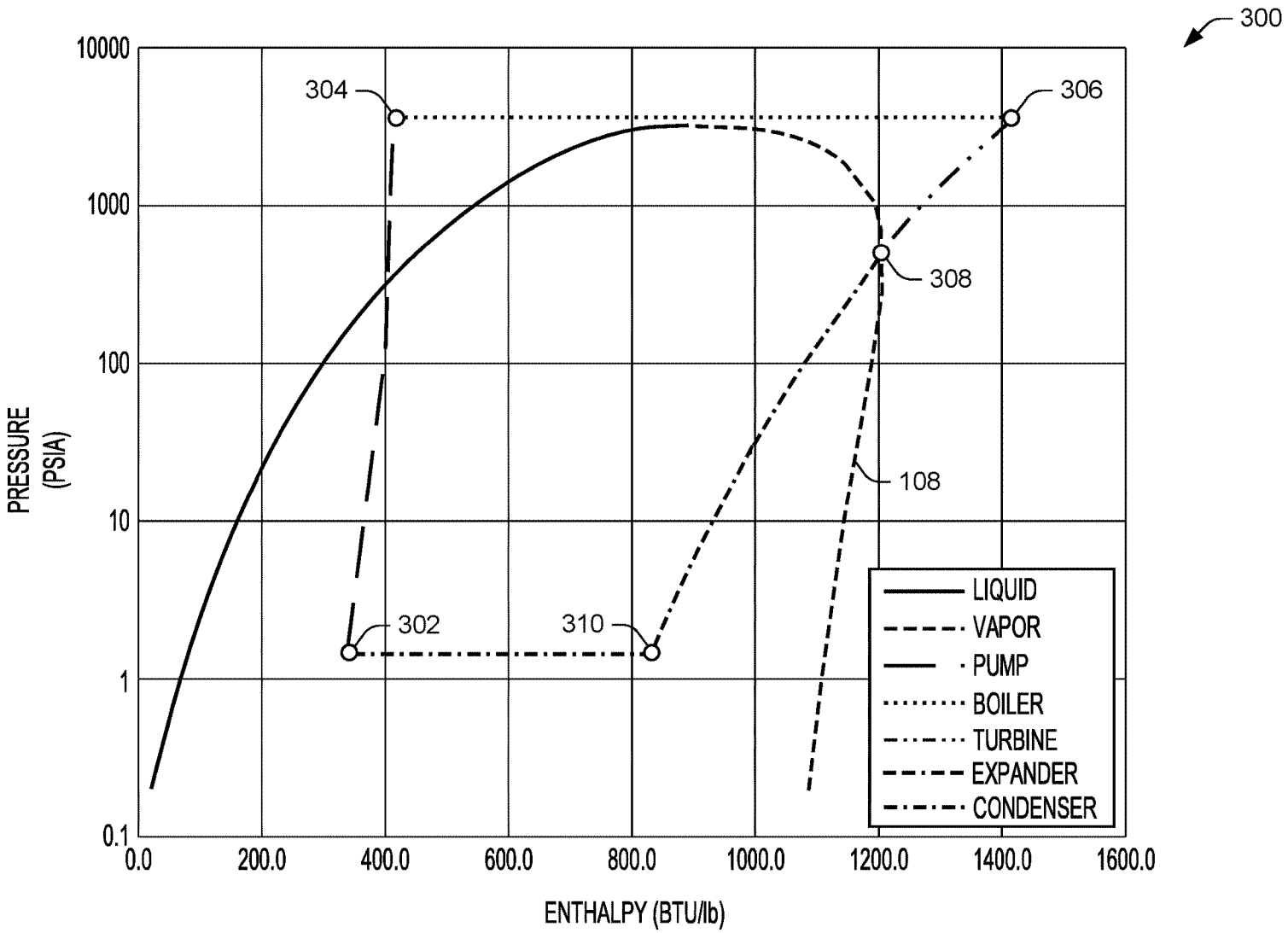
FIG. 3 illustrates an example pressure-enthalpy curve of a modified two-phase cycle using the system of FIG. 2, according to an embodiment of the present disclosure.

FIG. 3 illustrates an example modified two-phase cycle 300 on a pressure-enthalpy diagram. Pressure is shown on the y-axis while enthalpy is shown on the x-axis. In some instances, the modified two-phase cycle 300 may include pumping a fluid, boiling the fluid to steam, expressing the steam through a turbine, and condensing the fluid using the system 200, as discussed hereinabove with regard to FIG. 2. However, unlike conventional methods, the modified two-phase cycle 300 may extract energy from a two-phase fluid (i.e., both steam and liquid) or low-quality steam.

As shown in FIG. 3, between 302 and 304, the fluid may be compressed by a compressor (e.g., the compressor 214) and pumped by a pump (e.g., the pump 202) to an inlet pressure of a boiler (e.g., the boiler 204). Within the boiler 204, the fluid may be heated to a superheated state (i.e., high-quality steam), between 304 and 306. From 306 to 308, a turbine (e.g., the turbine 206) may extract energy from the fluid. For instance, as shown in FIG. 3, the modified two-phase cycle 300 may extract energy from the fluid until 308, which may represent a point where the fluid reaches the saturated vapor line 108. However, in some instances, the modified two-phase cycle 300 may extract energy from the fluid until just before the saturated vapor line 108 to reduce erosion on the turbine.

From 308, an expander (e.g., the expander 208) may receive the fluid from the turbine to extract additional energy. That is, the expander 208 may couple to the turbine to receive high-quality steam, saturated steam, or two-phase fluids from the turbine, so as to further extract energy via the rotary motion of the expander between 308 and 310. As noted above, a generator (e.g., the generator 212) may couple to, or be integrated with, the expander 208 to generate electricity. After passing through the expander 208, at 310, the fluid may be low-quality steam (e.g., 75 percent) or may be more saturated than when entered into the expander, at 308. Thereafter, the fluid may be condensed in a condenser (e.g., the condenser 210).

In some instances, the compressor may compress the two-phase fluid or low-quality steam. As discussed above with regard to the system 200 of FIG. 2, the fluid may be compressed in the compressor until an optimal state, whereby the fluid may then be pumped back to the operating pressure of the boiler. In some instances, the compressor may draw steam from the condenser so as to compress the steam, while the liquid may be drawn from the condenser without passing through the compressor (e.g., using the pump 216). By compressing the steam, as compared to condensing the steam, less energy may be required to heat the fluid within the boiler to create usable steam for the turbine.

In some instances, the modified two-phase cycle 300 may improve overall cycle efficiencies, as compared to conventional steam or Rankine cycles, between 2% to 20%. In some instances, the efficiency to the modified two-phase cycle 300 may be calculated by the following equation:

$$\varepsilon = \frac{\eta_{Turbine}\Delta H_{Turbine} + \eta_{Expander}\Delta H_{Expander} - \frac{\Delta H_{Pump}}{\eta_{Pump}} - \frac{\Delta H_{Compressor}}{\eta_{Compressor}}}{\Delta H_{Boiler}}$$

where ε represents efficiency of the modified two-phase cycle 300, $\eta_{Turbine}$ represents the efficiency of the turbine, $\Delta H_{Turbine}$ represents the change in enthalpy within the turbine, $\eta_{Expander}$ represents the efficiency of the expander, $\Delta H_{Expander}$ represents the changer in enthalpy within the expander, $\Delta H_{Pump}$ represents the change in enthalpy within the pump, $\eta_{Pump}$ represents the efficiency of the pump, $\Delta H_{Compressor}$ represents the efficiency of the compressor, $\eta_{Compressor}$ represents the change in enthalpy within the compressor, and $\Delta H_{Boiler}$ represents the change in enthalpy within the boiler.

Compared to conventional cycles, the modified two-phase cycle 300 may capture remaining enthalpies in two-phase fluids, for instance, using the expander 208. The compressor 214 meanwhile may compress the low-quality steam to reduce an amount of energy used by the boiler to create high-quality or saturated steam. In some instances, the compressor 214 may compress the two-phase fluid to substantially or about 97 percent liquid. Accordingly, instead of condensing the fluid once the fluid becomes saturated or low-equality (e.g., substantially or about 97 percent), the modified two-phase cycle 300 may utilize the expander 208 and/or the compressor 214 to increase an efficiency of conventional cycles. More specifically, as conventional steam cycles condense fluids once they become two-phase, by expanding the two-phase fluid through the expander, for instance, the modified two-phase cycle 300 may capture remaining enthalpies in the two-phase fluid.

Figure 4:
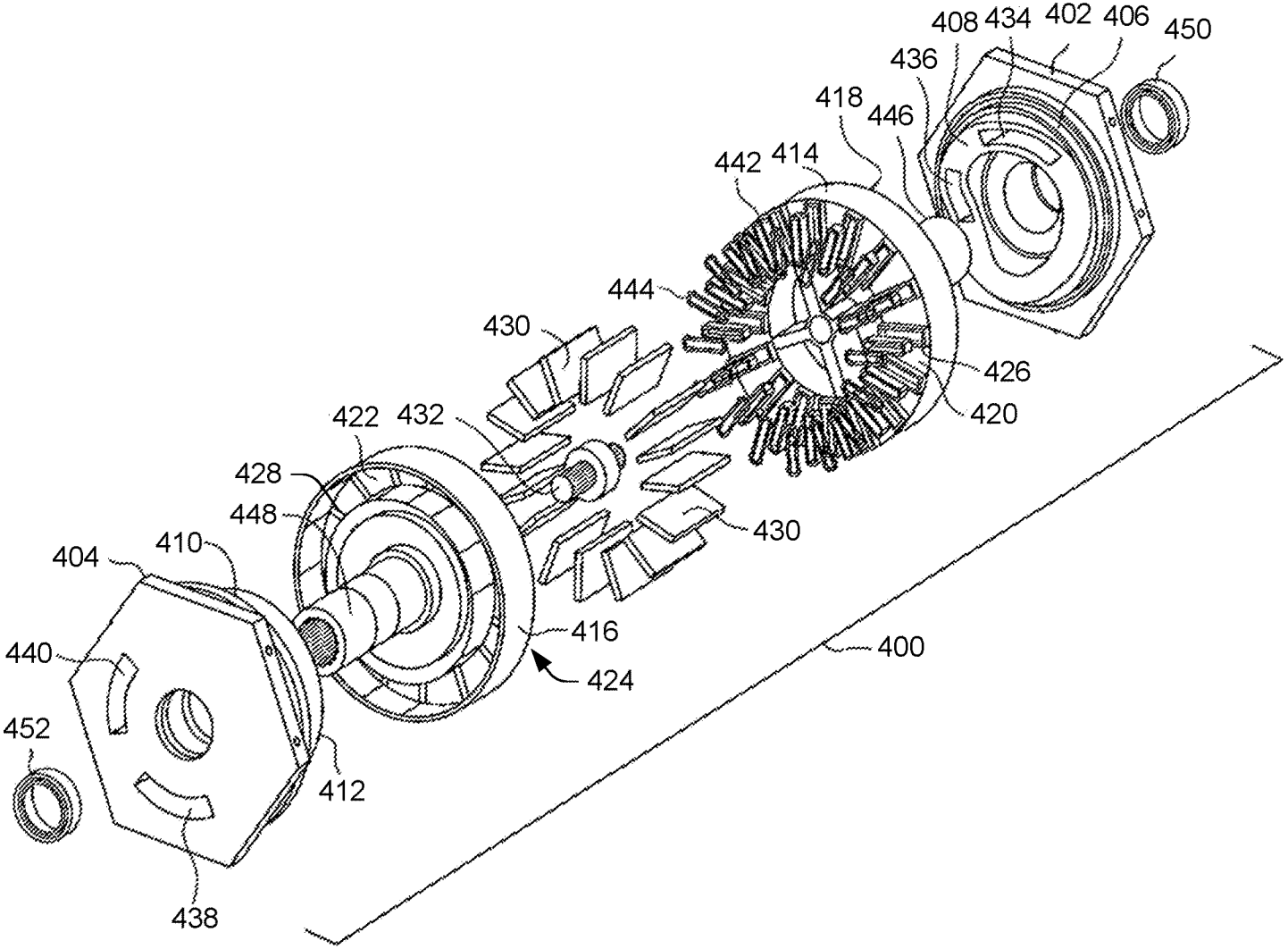
FIG. 4 illustrates an example rotary device usable within the example system of FIG. 2, according to an embodiment of the present disclosure.

FIG. 4 illustrates an example rotary device 400 that may be implemented in the system 200 of FIG. 2. In some instances, the rotary device 400 may be implemented, or usable, as an expander (e.g., the expander 208) and/or a compressor (e.g., the compressor 214), as discussed hereinabove and as detailed below with regard to FIGS. 5A and 5B, and FIGS. 6A and 6B, respectively. In some instances, the rotary device 400 may embody a rotary device as illustrated and discussed in U.S. Pat. No. 7,896,630, entitled "Rotary Device with Reciprocating Vans and Seals Thereof."

The rotary device 400 may include a first stator 402 and a second stator 404. The first stator 402 includes a first cam 406 having an undulating cam surface 408 which may, in some instances, include a substantially sinusoidal profile. The second stator 404 includes a second cam 410 having an undulating cam surface 412 which may, in some instances, include a substantially sinusoidal profile.

The rotary device 400 includes a first rotor member 414 and a second rotor member 416. The first rotor member 414 may be in rotating engagement with a periphery of the first cam 406 and has an interior annular surface 418 and an exterior surface 420. The interior annular surface 418 of the first rotor member 414 faces the undulating cam surface 408 of the first stator 402, and the exterior surface 420 of the first rotor member 414 faces the second stator 404 of the rotary device 400. Likewise, the second rotor member 416 may be in rotating engagement with a periphery of the second cam 410 and has an interior annular surface 422 and an exterior surface 424. The interior annular surface 422 of the second rotor member 416 faces the undulating cam surface 412 of the second stator 404, and the exterior surface 424 of the second rotor member 416 faces the first stator 402 of the rotary device 400.

The first rotor member 414 includes a plurality of angularly spaced slots 426 extending therethrough. The second rotor member 416 may also include a plurality of angularly spaced slots 428 extended therethrough.

The rotary device 400 may include vanes 430 reciprocating parallel to an axis of rotation of the first rotor member 414 and the second rotor member 416 to expand and/or compress fluids. The vanes 430 also move rotatably with respect to the first cam 402 and the second cam 404. Individual vanes 430 may extend through individual slots of the plurality of angularly spaced slots 426 in the first rotor member 414 and individual slots of the plurality of angularly spaced slots 428 in the second rotor member 416, respectively. Additionally, individual vanes 430 are in sliding engagement with the undulating cam surface 408 of the first cam 406 as the first rotor member 414. The individual vanes 430 are also in sliding engagement with the undulating cam surface 412 of the first cam 410 as the second rotor member 406 rotates.

In some instances, the undulating cam surface 408 of the first stator 402 and the undulating cam surface 412 of the second stator 404 may be 90-degrees out of phase with one another such that the vanes 430 move parallel to a direction of rotation. In some instances, this phase difference may balance the rotary device 400 such that the rotary device 400 exhibits minimal vibration. The first rotor member 414 and the second rotor member 416 may operably couple to one another via a shaft 432 to ensure coordinated rotation.

The rotary device 400 may include a plurality of chambers sized and configured to receive fluid. For instance, a plurality of chambers may form between the first cam 406, the first rotor member 414, and the vanes 430, between the first rotor member 414, the second rotor member 416, and the vanes 430, and/or between the second rotor member 416, the second cam 410, and the vanes 430. To receive the fluid, as shown in FIG. 1, the first cam 406 has an inlet port 434 and an exhaust port 436. Similarly, the second cam 410 may include an inlet port 438 and an exhaust port 440.

To seal the chambers, the individual slots of the plurality of angularly spaced slots 426 in the first rotor member 414 may have a seal 442 disposed around a periphery thereof. The seals 442 may serve to seal (e.g., pressurize) the chambers formed between the first rotor member 414, the first cam 406, and the vanes 430. In some instances, individual seals 442 may be held in place via a seal keeper 444 coupled to the exterior face 420 of the first rotor member 414. Additionally, as shown, individual seals 424 may be oblong-shaped to correspond to an exterior profile of the plurality of angularly spaced slots 426. Although not shown, the second rotor member 416 may similarly include seals to seal and pressurize the chambers formed between the second rotor member 416, the second cam 410, and the vanes 430.

Depending upon the application, the chamber volume may change as the vanes 430 move along the undulating cam surface 408 of the first cam 406 and the undulating cam surface 412 of the second cam 410 during a revolution of the first rotor member 414 and the second rotor member 416. Such revolutions result in alternately compressing and/or expanding fluids. For instance, the chambers may receive fluid (e.g., low-quality steam) from a turbine via the inlet port 434 and/or the inlet port 438. When embodied as an expander, the fluid expands within the chambers, resulting in a decrease in pressure. This expansion causes the vanes 430 to move and create rotary motion. To create energy from the rotary motion, the first rotor member 414 and the second rotor member 416 may couple to a shaft 446 and a shaft 448, respectively, which may be coupled to one or more generators. An end of the shaft 446 and the shaft 448 may respectively, engage with a bearing 450 and a bearing 452.

When embodied as a compressor, the vanes 430 may compress the fluid within the chambers via one or more motors or components of the system 200 (e.g., the turbine 206 and/or the expander 208) that drive the rotary device 400

In some instances, the rotary device 400 may be configured as a component capable of handling high-quality steam, low-quality steam, and/or two-phase fluids. Additionally, compared to turbines, which require high-velocity steam to be imparted on the turbine blades, in some instances, the rotary device 700 may receive low-velocity fluids to avoid imparting velocity to the fluid.

As noted above, the rotary device 400 may be configured as a compressor or an expander by changing or reorienting the undulating cam surface 408 of the first cam 406 and/or the undulating cam surface 412 of the second cam 410. Additionally, or alternatively, the rotary device 400 may be configured as a compressor or an expander by changing a location of the intake port 434 and the exhaust port 436, or the location of the intake port 438 and the exhaust port 440.

Figure 5A:
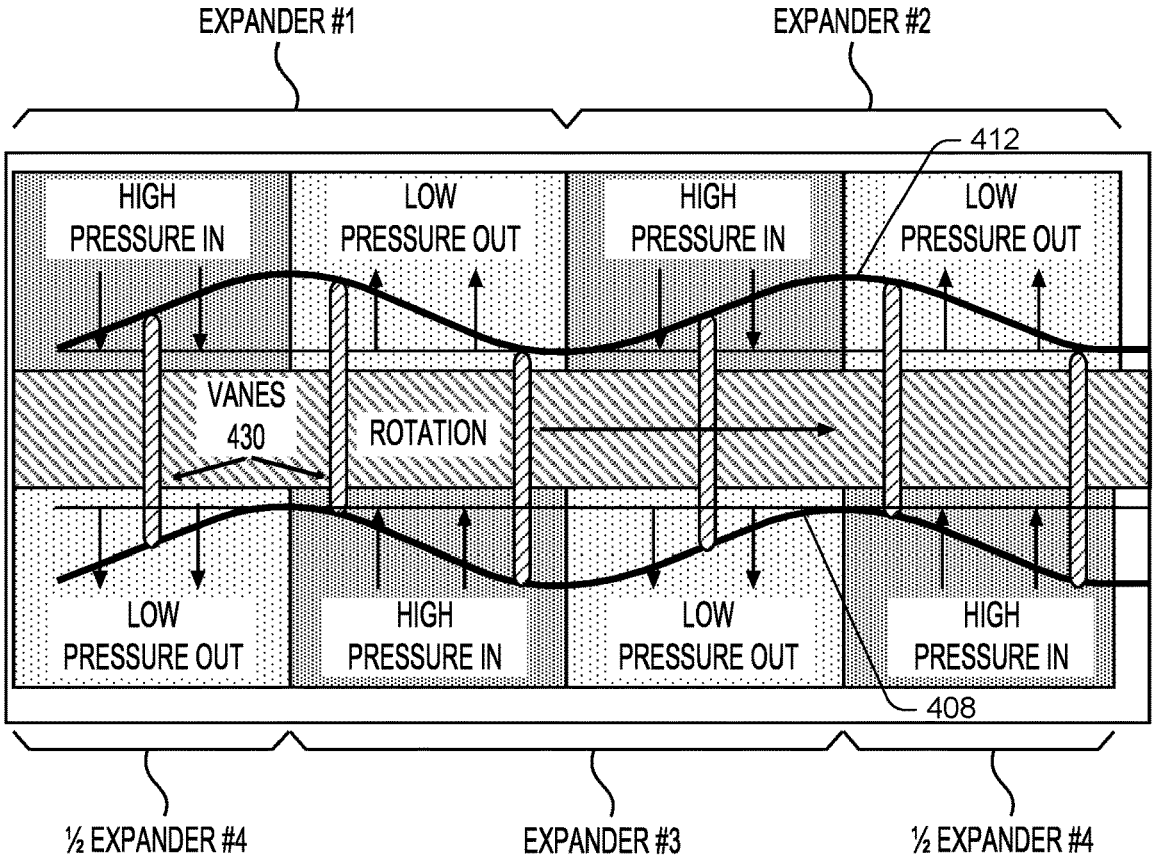
FIG. 5A illustrates an example expansion cycle of the example rotary device of FIG. 4, according to an embodiment of the present disclosure.
Figure 5B:
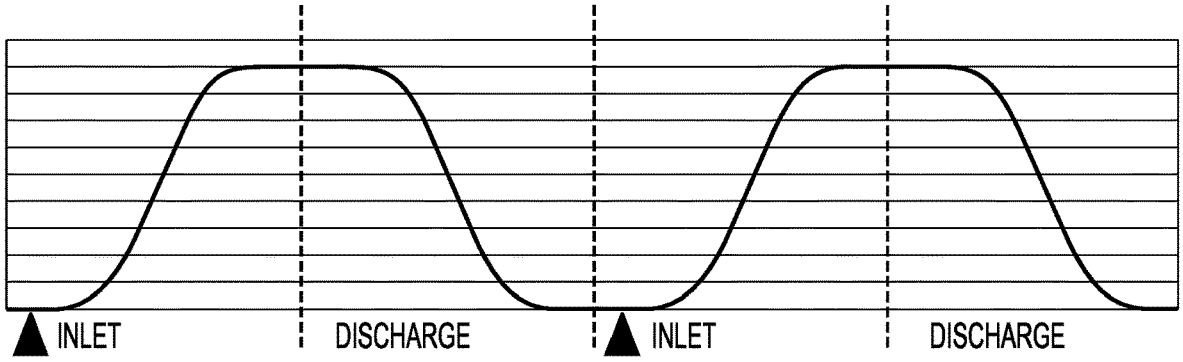
FIG. 5B illustrates a simplified diagrammatic view showing expansion cycles of the example rotary device of FIG. 4 when implemented as an expander, according to an embodiment of the present disclosure.

FIGS. 5A and 5B illustrates inlet and discharge cycles of a rotary device (e.g., the rotary device 400) implemented as an expander (e.g., the expander 208). More specifically, FIG. 5A illustrates two complete intake and discharge expansion cycles on each rotor of the rotary device, while FIG. 5B is a simplified diagrammatic view showing an expansion cycle of the rotary device. In some instances, the expansion cycle may be a combination of four distinct sections, which may allow for the configuration of different expansion ratios. Different porting options into and between chambers may also allow for expansion speed control.

In operation, vanes (e.g., the vanes 430) are axially driven by one or more cams (e.g., the first cam 406 or the second cam 410). The vanes also rotatably move with respect to one or more cams. As shown in FIGS. 5A and 5B, high-pressure fluid is received during intake or an inlet and is trapped between adjacent vanes. The fluid expands during an expansion stroke due to the increasing volume between the vanes. The fluid continues to drive the vanes until a leading vane reaches an exhaust port, at which time the expanded gases are exhausted and the cycle repeats. That is, the fluid expands from a high-pressure to a low-pressure to create rotary motion.

For instance, fluid from a turbine may be received through the intake port 434 and/or the intake port 438, as discussed above with regard to the rotary device 400. The fluid is trapped between adjacent vanes 430, the undulating cam surface 408 of the first stator 402 and/or the undulating cam surface 412 of the second stator 410. The fluid is then allowed to expand within chambers as the vanes 430 rotate and move up the undulating cam surface 408 and/or undulating cam surface 412. In some instances, during a rotor revolution, the vanes 430 follow a path that approximates a sinusoidal wave. With a sinusoidal path, during each revolution of a rotor, the volume of the chambers alternately expand and contract. During the expansion cycle, the fluid expands due to an increasing volume between the adjacent vanes 430 and the undulating cam surface 408 of the first stator 402 and/or the undulating cam surface 412 of the second stator 410. As a result, the volume constantly increases as the vanes 430 move along the undulating cam surface 408 and/or undulating cam surface 412 towards the lowest point on the first cam 402 and/or the second cam 404. Once expanded, the fluid may discharge at the exhaust port 436 and/or the exhaust port 440.

Figure 6A:
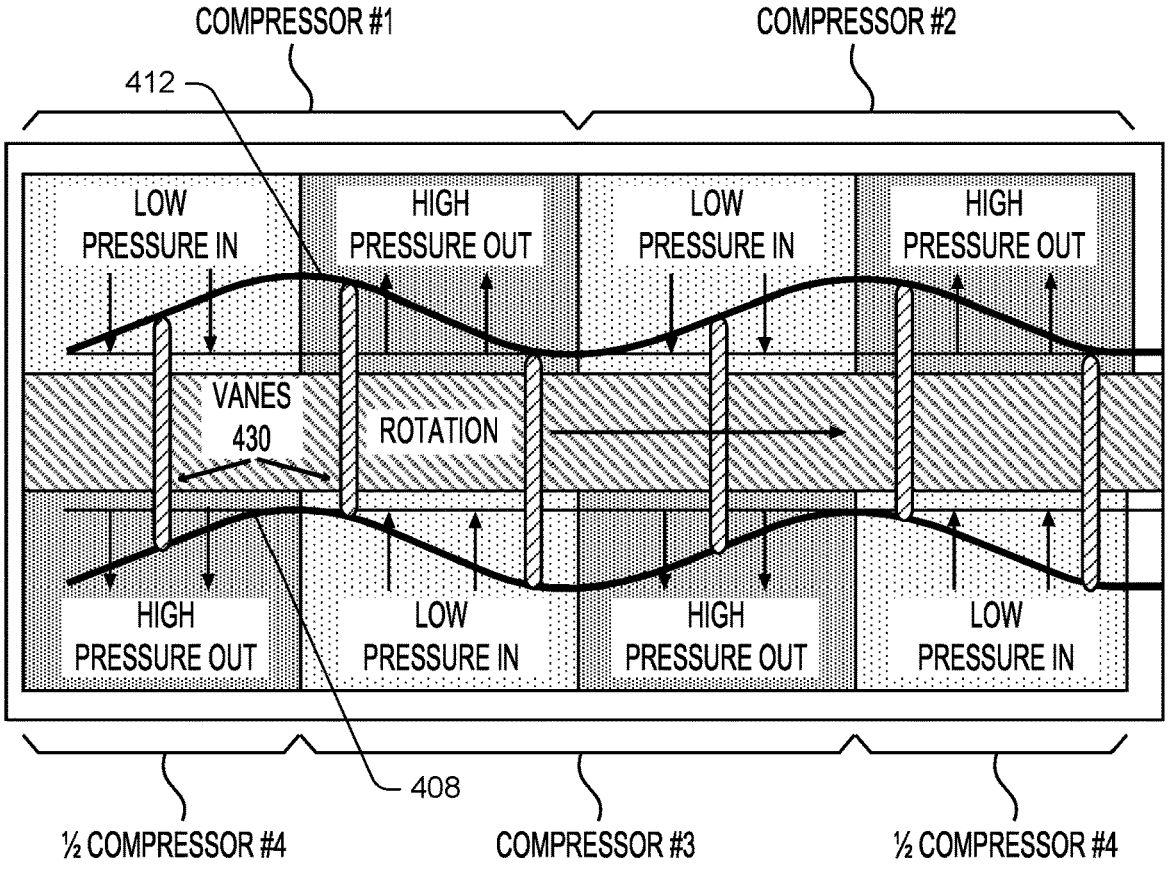
FIG. 6A illustrates an example compression cycle of the example rotary device of FIG. 4, according to an embodiment of the present disclosure.
Figure 6B:
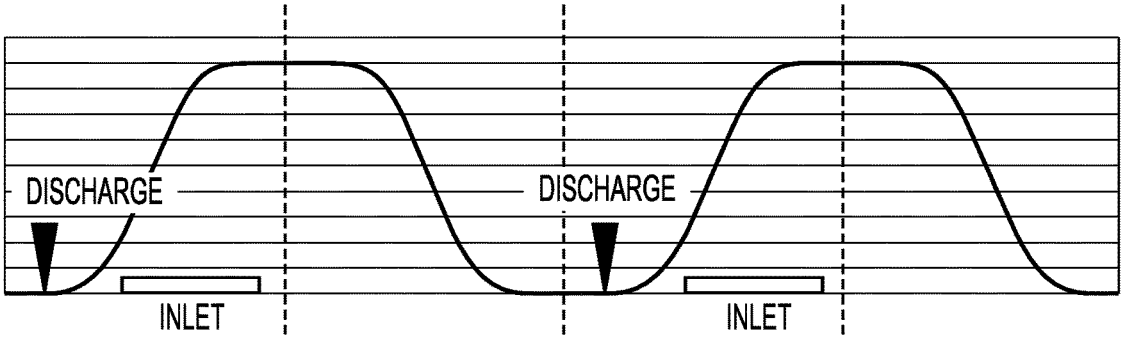
FIG. 6B illustrates a simplified diagrammatic view showing compression cycles of the example rotary device of FIG. 4 when implemented as a compressor, according to an embodiment of the present disclosure.

FIGS. 6A and 6B illustrates inlet and discharge cycles of a rotary device (e.g., the rotary device 400) implemented as a compressor (e.g., the compressor 214). More specifically, FIG. 6A illustrates two complete intake and discharge compression cycles on each rotor of the rotary device, while FIG. 6B is a simplified diagrammatic view showing the compression cycle of the rotary device. In some instances, the compression cycle may be a combination of four distinct sections, which may allow for the configuration of different expansion ratios. Different porting options into and between chambers may also allow for expansion speed control.

In operation, vanes (e.g., the vanes 430) are axially driven by one or more cams (e.g., the first cam 406 or the second cam 410). The vanes also rotatably move with respect to the one or more cams (e.g., the first cam 406 and the second cam 410). As shown in FIGS. 6A and 6B, low-pressure fluid is received during intake or an inlet and is trapped between adjacent vanes. The fluid compresses during a compression stroke due to the decreasing volume between the vanes. The fluid continues to compress until a leading vane reaches an exhaust port, at which time the compressed fluid are exhausted and the cycle repeats. That is, rotary motion causes the fluid compresses from a low-pressure state to a high-pressure state. For instance, fluid (e.g., steam) from a condenser, expander, and/or turbine may be received through the intake port 434 and/or the intake port 438, as discussed above with regard to the rotary device 400. The fluid is trapped between adjacent vanes 430, the undulating cam surface 408 of the first stator 402 and/or the undulating cam surface 412 of the second stator 410. The fluid is then compressed within chambers as the vanes 430 rotate and move up the undulating cam surface 408 and/or undulating cam surface 412. In some instances, during a rotor revolution, the vanes 430 follow a path that approximates a sinusoidal wave. With a sinusoidal path, during each revolution of a rotor, the volume of the chambers alternately expand and contract. During the compression cycle, the fluid compresses due to a decreasing volume between the adjacent vanes 430 and the undulating cam surface 408 of the first stator 402 and/or the undulating cam surface 412 of the second stator 410. As a result, the volume constantly decreases as the vanes 430 approach the peak of the undulating cam surface 408 and/or undulating cam surface 412. Once compressed, the fluid is discharged at the exhaust port 436 and/or the exhaust port 440.

Figure 7A:
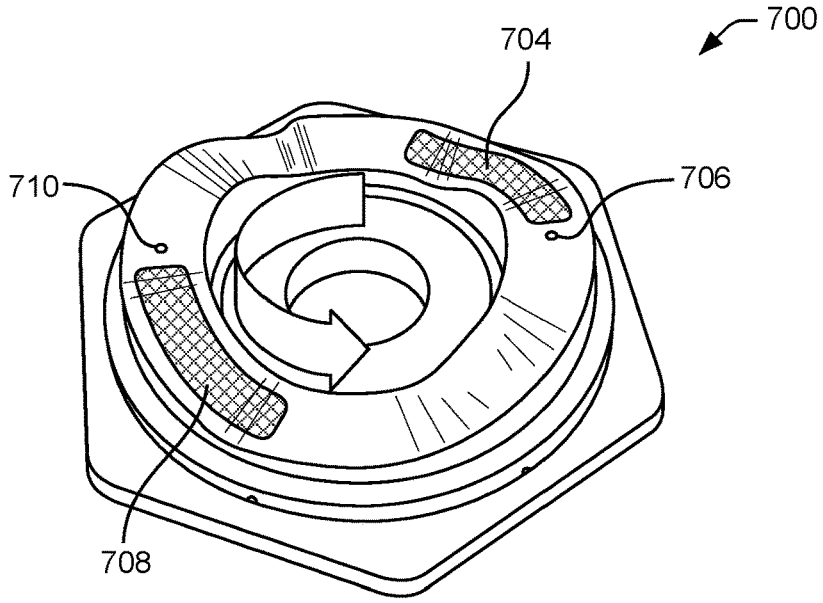
FIG. 7A illustrates an example rotor of the example rotary device of FIG. 4 usable during the example compression cycles of FIGS. 6A and 6B, according to an embodiment of the present disclosure.
Figure 7B:
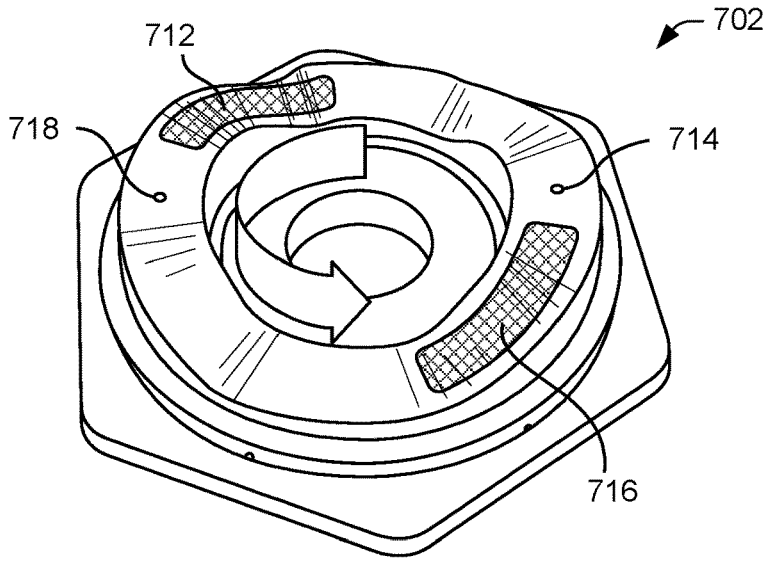
FIG. 7B illustrates an example rotor of the example rotary device of FIG. 4 usable during the example expansion cycles of FIGS. 5A and 5B, according to an embodiment of the present disclosure.

FIGS. 7A and 7B illustrate a cam according to compressor and expander configurations. More particularly, FIG. 7A illustrates a cam member 700 of a rotary device in a compressor configuration, while FIG. 7B illustrates a cam member 702 of a rotary device in an expander configuration.

In FIG. 7A, the cam member 700 includes a low-pressure inlet 704, a high-pressure discharge 706, a low-pressure inlet 708, and a high-pressure discharge 710. The low-pressure inlet 704 and the low-pressure inlet 708 may receive steam, or low-quality steam from a condenser, expander, and/or a turbine. After being compressed to a high-pressure state and compressing to liquid, as discussed hereinabove, the high-pressure fluid may exit through the high-pressure discharge 706 and the high-pressure discharge 710, respectively.

In FIG. 7B, the cam member 702 includes a low-pressure discharge 712, a high-pressure inlet 714, a low-pressure discharge 716, and a high-pressure inlet 718. The high-pressure inlet 714 and the high-pressure inlet 718 may receive low-quality steam from a turbine. After expanding within the expander to a low-pressure state, as discussed hereinabove, the low-pressure fluid may exit through the low-pressure discharge 712 and the low-pressure discharge 716, respectively.

Figure 8:
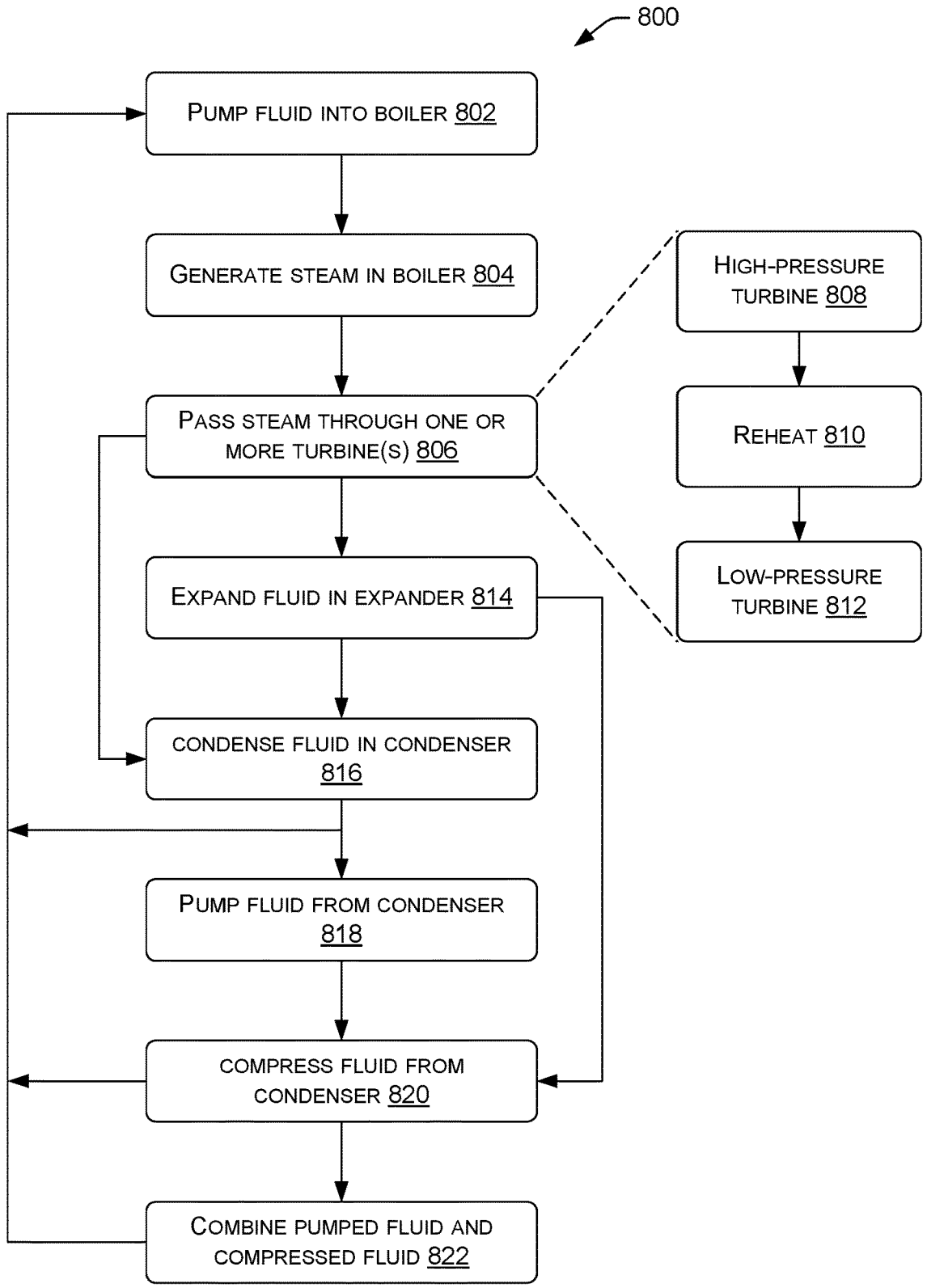
FIG. 8 illustrates an example process showing the modified two-phase cycle, according to an embodiment of the present disclosure.

FIG. 8 illustrates an example process 800 according to a modified two-phase cycle. In some instances, the process 800 may be implemented using the system 200 described hereinabove.

Beginning at 802, the process 800 may pump fluid into a boiler. For instance, the pump 202 may pump fluid into the boiler 204, and up to an inlet pressure of the boiler 204.

At 804, the process 800 may generate steam within the boiler. For instance, the boiler 204 may burn fuel to heat the fluid to a superheated state to create steam that that contains zero percent liquid or substantially zero percent liquid.

At 806, the process 800 may pass the steam through one or more turbine(s). For instance, the turbine 206 may receive the high-quality steam from the boiler 204. As a result, the steam may enter the turbine 206 and rotate turbine blades to create power, via a generator coupled to the turbine 206. As shown in FIG. 8, passing the steam through the one or more turbine(s) may include sub-blocks 808, 810, and 812. For instance, passing the steam through the one or more turbine (s) may include passing the steam through a high-pressure turbine at 808, reheating the fluid to a superheated state or high-quality at 810, and then passing the steam through a low-pressure turbined at 812. However, in some instances, while the process 800 illustrates a single reheat cycle and passing the fluid through a single low-pressure turbine, the process 800 may include more than one reheat and may pass the fluid through more than one low-pressure turbine.

From 806, at 814, the process 800 may, in some instances, expand the fluid in an expander. For instance, the expander 208 may receive, from a high-pressure turbine and/or a low-pressure turbine, the fluid. In some instances, the fluid may be two-phase or may be high-quality steam. For instance, the expander 208 may receive the fluid from the one or more turbine(s) prior to the fluid becoming two-phases so as to avoid damage to the turbine blades. In passing through the expander 208, or while passing through the expander 208, the steam may expand into a two-phase fluid. As noted above, expanding the steam into the two-phase fluid may create rotary motion used to create power, for instance, via a generator 212 operably coupled to the expander 208. Accordingly, after passing through the expander 208, the fluid may be low-quality or may be more saturated than when entered into the expander 208.

In some instances, the expander 208 may be configured to create power using low-quality steam. For instance, in some examples, the expander 208 may be configured to create power from steam having a quality at or below 75 percent. In some examples, the expander 208 may be configured to create power from steam from a superheated state down to a quality of about 75 percent. However, in other examples, the expander 208 may be configured to create power from steam having any quality from 0 to 100.

At 816, the process 800 may, in some instances, condense the fluid in a condenser. For instance, the condenser 210 may receive the two-phase fluid from the expander 208 to condense and cool the two-phase fluid to a liquid state (e.g., 100 percent liquid). Alternatively, in some instances and as shown in FIG. 8, the condenser 210 may receive the fluid (e.g., high-quality steam) directly from the turbine 206. In such instances, the process 800 may omit expanding the fluid within the expander 208.

From 816, the process 800 may, in some instances, loop to 802 whereby the pump 202 may pump the fluid into the boiler 204. Alternatively, in some instances, from 816, the process 800 may proceed to 818 whereby a pump may pump fluid from the condenser 210. From instance, at 818, a pump 216 may be utilized in instances where the condenser 210 is not operating efficiently so as to draw liquid from within the condenser 210.

At 820, the process 800 may compress fluid received from the condenser. For instance, rather than waiting for steam within the fluid to condense, a compressor 214 may receive steam from the condenser 210 and compress the steam into a liquid. That is, the compressor 214 may receive, or draw, the steam from the two-phase fluid within the condenser 210 so as to only compress the steam. Noted above, the liquid from the two-phase fluid may be drawn by the pump 216. Accordingly, at 822, the process may combine the pumped fluid (from 818) and the compressed fluid (from 820). Therein, the process 800 may loop to 802 whereby the liquid is pumped into the boiler 204.

Alternatively, as shown in FIG. 8, at 820, the process 800 may compress fluid received from the expander. For instance, the compressor 214 may receive the two-phase fluid from the expander 208 and compress the fluid to a liquid. In such instances, from 820, the process 800 may loop to 802.

Utilizing the process 800, the expander 208 and/or the compressor 214 may, collectively or individually, improve the efficiency of conventional systems between 5% and 10%, 10% and 15%, or 15% and 20% by extracting energy from two-phase fluids (i.e., under the vapor dome) or low-quality steam, as compared to conventional cycles or systems that are unable to extract such energy.

CONCLUSION

While various examples and embodiments are described individually herein, the examples and embodiments may be combined, rearranged and modified to arrive at other variations within the scope of this disclosure. In addition, although the subject matter has been described in language specific to structural features and/or methodological acts, it is to be understood that the subject matter defined in the appended claims is not necessarily limited to the specific features or acts described. Rather, the specific features and acts are disclosed as illustrative forms of implementing the claims.

What is claimed is:

1. A system, comprising:

a pump;

a boiler coupled to the pump;

a turbine coupled to the boiler;

an expander coupled to the turbine, wherein the expander is configured to receive steam from the turbine and expand the steam into a two-phase fluid;

a condenser coupled to the expander; and a compressor coupled directly to the condenser and the pump, wherein the compressor is configured to receive at least a portion of the two-phase fluid from the condenser and compress the at least the portion of the two-phase fluid into a saturated liquid that is received by the pump.

2. The system of claim 1, wherein at least one of the expander or the compressor includes a rotary device having a rotor and a plurality of chambers separated by vanes that move along a surface of the rotor.

3. The system of claim 2, wherein the vanes move axially in relation to the rotor.

4. The system of claim 1, wherein the steam received by the expander comprises superheated steam.

5. The system of claim 1, wherein at least one of:

the expander comprises a positive-displacement expander;

the compressor comprises positive-displacement compressor;

the expander comprises a radial-flow low expander; or the compressor comprises a centrifugal compressor.

6. The system of claim 1, wherein the pump comprises a first pump and the at least the portion of the two-phase fluid comprises a first portion of the two-phase fluid, the system further comprising a second pump coupled to the condenser and the first pump, the second pump configured to receive a second portion of the two-phase fluid from the condenser.

7. The system of claim 6, wherein:

the first portion of the two-phase fluid comprises substantially steam; and the second portion of the two-phase fluid comprises substantially liquid.

8. A system, comprising:

a pump;

a boiler coupled to the pump;

a turbine coupled to the boiler;

a two-phase expander coupled to the turbine, wherein the two-phase expander is configured to receive saturated steam from the turbine; and a condenser coupled to the two-phase expander and the pump.

9. The system of claim 8, wherein the steam received by the two-phase expander comprises steam having a quality of at least about 97 percent.

10. The system of claim 8, further comprising a two-phase compressor coupled to the condenser and the pump, wherein the two-phase compressor receives fluid from the condenser, and wherein an output of the two-phase compressor is received by the pump.

11. The system of claim 10, wherein the output of the two-phase compressor comprises liquid having a quality of at least about 97 percent.

12. The system of claim 8, further comprising a generator coupled to the two-phase expander.

13. A method of generating power, the method comprising:

boiling a fluid in a boiler to create superheated steam, diffusing the superheated steam through a turbine;

expanding the superheated steam in a two-phase expander to create a two-phase fluid;

condensing a first portion of the two-phase fluid in a condenser to create liquid;

compressing a second portion of the two-phase fluid in a compressor to create liquid; and pumping the liquid into the boiler.

14. The method of claim 13, further comprising converting, using one or more generators, a rotational movement of the turbine and the two-phase expander to generate electricity.

15. The method of claim 13, wherein the compressor comprises a two-phase compressor.

16. The method of claim 13, further comprising bypassing the first portion of the two-phase fluid from the compressor to a location after which the second portion of the two-phase fluid is compressed in the compressor.

17. The method of claim 13, wherein at least one of the two-phase expander or the compressor includes a rotary device.

18. The method of claim 17, wherein:

the rotary device includes a rotor, chambers, and vanes interposed between the chambers; and the vanes reciprocate parallel to an axis of rotation of the rotor.

19. The method of claim 13, wherein the liquid comprises water, refrigerant, or ammonia.

20. The system of claim 10, further comprising a compressor coupled directly to the condenser and the pump, wherein the compressor is configured to receive at least a portion of a two-phase fluid from the condenser and compress the at least the portion of the two-phase fluid into a saturated liquid that is received by the pump.

* * * * *